US012102194B2

(12) United States Patent
Luo

(10) Patent No.: US 12,102,194 B2
(45) Date of Patent: Oct. 1, 2024

(54) ZIPPER PULL CAPABLE OF BEING QUICKLY ASSEMBLED WITH PULL TAB

(71) Applicant: Dongguan Lexiang Hardware Zipper Products Co., LTD, Dongguan (CN)

(72) Inventor: Futian Luo, Dongguan (CN)

(73) Assignee: DONGGUAN LEXIANG HARDWARE AND ZIPPER PRODUCTS CO., LTD, Dongguan (CN)

( * ) Notice: Subject to any disclaimer, the term of this patent is extended or adjusted under 35 U.S.C. 154(b) by 0 days.

(21) Appl. No.: 18/349,958

(22) Filed: Jul. 11, 2023

(65) Prior Publication Data

US 2023/0346084 A1 Nov. 2, 2023

(30) Foreign Application Priority Data

Dec. 7, 2022 (CN) ..... 202223269246.8

(51) Int. Cl.
*A44B 19/26* (2006.01)

(52) U.S. Cl.
CPC ..... *A44B 19/262* (2013.01)

(58) Field of Classification Search
CPC ..... A44B 19/262; A44B 19/26
See application file for complete search history.

(56) References Cited

U.S. PATENT DOCUMENTS

| | | | | | |
|---|---|---|---|---|---|
| 2,974,382 | A * | 3/1961 | Carlile | A44B 19/388 | 24/433 |
| 4,823,447 | A * | 4/1989 | Akashi | A44B 19/262 | 24/429 |
| 5,551,129 | A * | 9/1996 | Chu | A44B 19/26 | 24/429 |
| 5,991,982 | A * | 11/1999 | Wakabayashi | A44B 19/26 | 24/429 |
| 2002/0069494 | A1 | 6/2002 | McCrum | | |
| 2013/0318751 | A1* | 12/2013 | Lin | A44B 19/262 | 24/429 |
| 2015/0335107 | A1* | 11/2015 | Hamada | A44B 19/262 | 24/429 |
| 2017/0295891 | A1* | 10/2017 | Honda | A44B 19/262 | |
| 2017/0347757 | A1 | 12/2017 | Nettles | | |
| 2019/0090596 | A1 | 3/2019 | Huyke-Phillips et al. | | |
| 2021/0022456 | A1* | 1/2021 | Hosoe | A44B 19/26 | |

* cited by examiner

*Primary Examiner* — Robert Sandy
*Assistant Examiner* — Rowland Do
(74) *Attorney, Agent, or Firm* — Hemisphere Law, PLLC; Zhigang Ma

(57) ABSTRACT

The present disclosure discloses a zipper pull capable of being quickly assembled with a pull tab, including an upper wing plate and a lower wing plate; the lower wing plate is fixedly arranged at a bottom of the upper wing plate; the upper wing plate is fixedly provided with a pull nose; a limiting block is arranged at a tail end of the pull nose; the limiting block is provided with a torsional spring shaft; and the limiting block is movably connected to the pull nose through the torsional spring shaft. One end of the pull nose of the zipper pull is fixedly connected to the upper wing plate, and the other end of the pull nose is movably provided with hinged limiting block.

5 Claims, 2 Drawing Sheets

ZIPPER PULL CAPABLE OF BEING QUICKLY ASSEMBLED WITH PULL TAB

TECHNICAL FIELD

The present disclosure relates to the related technical field of zipper pulls, and in particular, to a zipper pull capable of being quickly assembled with a pull tab.

BACKGROUND

In clothes, bags, and the like, zippers are used to connect components, so that the components can be opened or closed freely. Zippers are widely used in daily life. At present, most zipper pulls are fixed one-pieces. A zipper pull main body is fixedly connected to a pull nose. The pull nose is pulled through a pull tab to pull an upper wing plate and a lower wing plate. The pull nose is generally of a closed ring structure. During manufacturing, the pull tab is interlocked with the pull nose. After long-time use, it is inevitable that a locked position of the pull tab or the pull nose will break. After the pull tab is broken, a new pull tab cannot be replaced on the pull nose.

An existing zipper pull of a zipper No. 202020265055.6 is characterized by including a slider body and a movable body; the movable body is movably connected to the slider body; the movable body includes a movable plate and an elastic sheet; the movable plate is movably connected to the slider body; the movable plate includes a first end and a second end; the first end is movably connected to the slider body through the elastic sheet; the second end presses against the slider body; the second end is lifted and separated relative to the slider body; and the elastic sheet can reset the second end.

The above technology can solve the problem that the pull nose can be opened and closed for assembling of a new pull tab. However, during assembling a pull tab, it is necessary to press the movable plate. An opening is reserved in the pull nose to replace the pull tab. Furthermore, since the zipper pull is small, it is difficult and elaborate to press the movable plate with a finger and assemble the pull tab, and it takes long time to assemble the pull tab. Therefore, a zipper pull capable of improving the pull tab assembling efficiency is needed.

SUMMARY

The present disclosure aims to provide a zipper pull capable of being quickly assembled with a pull tab, so as to solve the problem of low pull tab assembling efficiency in the prior art.

In order to achieve the above objective, the present disclosure provides the following technical solution:

A zipper pull capable of being quickly assembled with a pull tab includes an upper wing plate and a lower wing plate, wherein the lower wing plate is fixedly arranged at a bottom of the upper wing plate; the upper wing plate is fixedly provided with a pull nose; a limiting block is arranged at a tail end of the pull nose; the limiting block is provided with a torsional spring shaft; and the limiting block is movably connected to the pull nose through the torsional spring shaft.

In a further description, hinge holes are formed in both the limiting block and the pull nose; and the torsional spring shaft penetrates through the limiting block and the pull nose through the hinge holes.

In a further description, a bottom of the limiting block is in non-contact connection with the upper wing plate.

In a further description, a spring end of the torsional spring shaft respectively abuts against a bottom of the pull nose and an inner side wall of the limiting block.

In a further description, a tail end of the pull nose further outwards extends to form a positioning portion; and the positioning portion is used for restraining an outwards turning angle of the limiting block.

Compared with the prior art, the present disclosure has the beneficial effects as follows:

One end of the pull nose of the zipper pull is fixedly connected to the upper wing plate, and the other end of the pull nose is movably provided with hinged limiting block. After the pull tab is broken, a new pull tab is directly used to abut against an outer side wall of the hinged limiting block to provide a certain feeding force, so that the hinged limiting block inwards rotates, and the pull tab can be plugged into the pull nose. The hinged limiting block is then reset under the action of the torsional spring shaft, and the assembling speed of the pull tab is increased.

REFERENCE NUMERALS IN DRAWINGS

Figure 1:
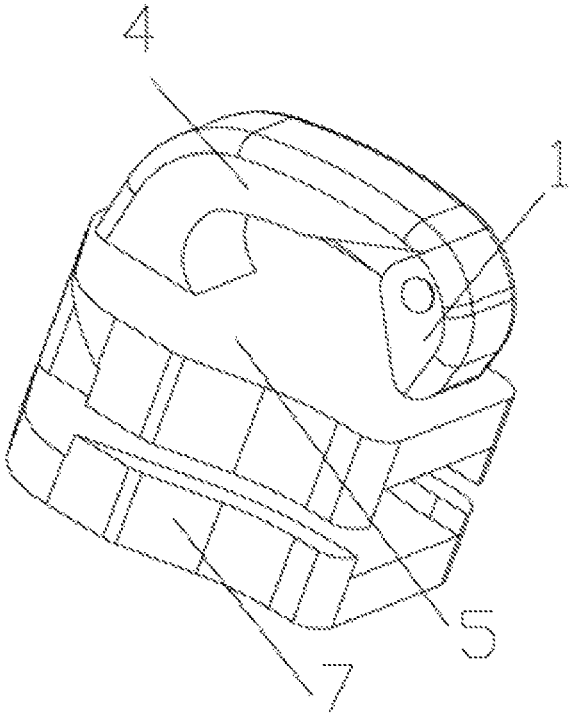
FIG. 1 is a three-dimensional view of the present disclosure.

1: limiting block; 2: torsional spring shaft; 3: pull nose; 4: positioning portion; 5: upper wing plate; and 7: lower wing plate.

DETAILED DESCRIPTION OF THE EMBODIMENTS

In order to make the foregoing objectives, features and advantages of the present disclosure more obvious and understandable, the specific implementation modes of the present disclosure are described in detail with reference to the accompanying drawings. Many specific details are described in the following descriptions to facilitate full understanding of the present disclosure. However, the present disclosure can be implemented in a variety of other ways different from those described herein, and those skilled in the art can make similar improvements without departing from the connotation of the present disclosure. Therefore, the present disclosure is not limited by specific embodiments disclosed below.

It should be noted that when an element is referred to as being "fixed" to another element, it can be directly on the other element or an intermediate element may also exist. When one element is considered to be "connected" to another element, it can be directly connected to another element or there may be a central element at the same time. When the number of one element is said to have "multiple", it can be any number of two or more. The terms "perpendicular", "horizontal", "left", "right" and similar expressions used herein are for illustrative purposes only, and are not meant to be the only implementation modes.

Unless otherwise defined, all technical and scientific terms used herein are the same as meanings of general understandings of those skilled in the art of the present disclosure. The terms used in the description of the present disclosure herein are merely to describe the specific implementation modes, not intended to limit the present disclosure. The term "and/or" used herein includes any and all combinations of one or more related listed items.

Figure 2:
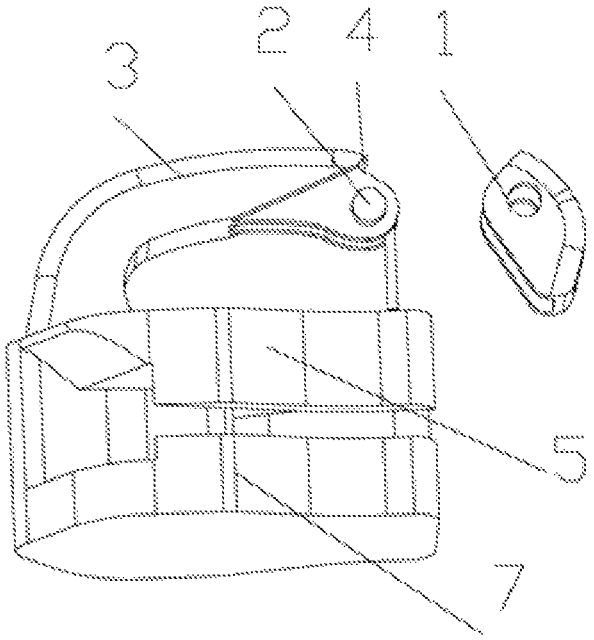
FIG. 2 is an exploded diagram of the present disclosure.

The present disclosure is described below in detail in combination with all implementation modes shown in the drawings:

As shown in FIG. 1 to FIG. 2, this embodiment provides a zipper pull capable of being quickly assembled with a pull tab, including an upper wing plate 5 and a lower wing plate 7. The lower wing plate 7 is fixedly arranged at a bottom of the upper wing plate 5. A zipper slides through a space between the lower wing plate 7 and the upper wing plate 5 in sequence to achieve opening and closing. The upper wing plate 5 is fixedly provided with a pull nose 3. The pull nose 3 is different from the existing pull nose. The pull nose 3 of the present disclosure is not closed with the upper wing plate 5. One end of the pull nose 3 is fixed to the upper wing plate 5, but the other end is suspended above the upper wing plate 5. A tail end of the pull nose 3 is provided with a limiting block 1. Hinge holes are formed in both the limiting block 1 and the pull nose 3. The torsional spring shaft 2 penetrates through the limiting block 1 and the pull nose 3 through the hinge holes and is arranged in the limiting block 1. The limiting block 1 is movably connected to the pull nose 3 through the torsional spring shaft 2. A bottom of the limiting block 1 is in non-contact connection with the upper wing plate 5. A certain gap is reserved between the limiting block 1 and the upper wing plate 5. It is worth mentioning that this gap cannot be too large. A height of the gap shall be less than a thickness of a to-be-assembled pull tab. During assembling, the pull tab is pressed hard while resisting against the gap, and the limiting block 1 may be stressed to rotate towards an arch portion of the pull nose 3, so that the above gap is made to allow the pull tab to be plugged. The limiting block 1 needs to be pressed with a hand.

A spring end of the torsional spring shaft 2 respectively abuts against a bottom of the pull nose 3 and an inner side wall of the limiting block 1, so that due to an elastic varying stress, the limiting block 1 can be reset in time to lock a pull ring of the pull tab after the limiting block 1 rotates. A tail end of the pull nose 3 further outwards extends to form a positioning portion 4. The resetting of the limiting block 1 can be stopped by a component. The above positioning portion 4 is used for restraining an outwards turning angle of the limiting block 1.

The various technical features of the above embodiments can be combined arbitrarily. To make the description concise, all possible combinations of the various technical feature in the above embodiments have not been described. However, the combinations of these technical features shall fall within the scope of this specification as long as they have no conflicts. For those of ordinary skill in the art, several deformations and improvements can also be made without departing from the concept of the present disclosure, all of which fall within the protection scope of the present disclosure. Therefore, the protection scope of the patent of the present disclosure shall be subject to the appended claims.

What is claimed is:

1. A zipper pull capable of being quickly assembled with a pull tab, comprising an upper wing plate and a lower wing plate, wherein the lower wing plate is fixedly arranged at a bottom of the upper wing plate; the upper wing plate is fixedly provided with a pull nose; a limiting block is arranged at a tail end of the pull nose; the limiting block is provided with a torsional spring shaft; and the limiting block is movably connected to the pull nose through the torsional spring shaft.

2. The zipper pull capable of being quickly assembled with the pull tab according to claim 1, wherein hinge holes are formed in both the limiting block and the pull nose; and the torsional spring shaft penetrates through the limiting block and the pull nose through the hinge holes.

3. The zipper pull capable of being quickly assembled with the pull tab according to claim 1, wherein a bottom of the limiting block is in non-contact connection with the upper wing plate.

4. The zipper pull capable of being quickly assembled with the pull tab according to claim 1, wherein a spring end of the torsional spring shaft respectively abuts against a bottom of the pull nose and an inner side wall of the limiting block.

5. The zipper pull capable of being quickly assembled with the pull tab according to claim 1, wherein a tail end of the pull nose further outwards extends to form a positioning portion; and the positioning portion is used for restraining an outwards turning angle of the limiting block.

* * * * *